US008246070B2

(12) United States Patent
Lin

(10) Patent No.: US 8,246,070 B2
(45) Date of Patent: Aug. 21, 2012

(54) SNOW GLIDER WITH ELEVATED CHATTER-ABSORBING RIDER DECK

(76) Inventor: An Hao Adams Lin, San Mateo, CA (US)

( * ) Notice: Subject to any disclaimer, the term of this patent is extended or adjusted under 35 U.S.C. 154(b) by 848 days.

(21) Appl. No.: 12/177,781

(22) Filed: Jul. 22, 2008

(65) Prior Publication Data

US 2009/0206564 A1 Aug. 20, 2009

Related U.S. Application Data

(60) Provisional application No. 61/007,631, filed on Dec. 14, 2007.

(51) Int. Cl.
*A63C 5/07* (2006.01)

(52) U.S. Cl. ..... 280/602; 280/607; 280/11.14; 280/609; 280/618; 280/14.22; 280/14.26; 280/87.042

(58) Field of Classification Search ..... 280/11.12, 280/601, 602, 607, 11.14, 11.18, 608, 609, 280/11.225, 618, 14.22, 14.25, 14.26, 87.041, 280/87.042
See application file for complete search history.

(56) References Cited

U.S. PATENT DOCUMENTS

| | | | | |
|---|---|---|---|---|
| 3,260,532 | A * | 7/1966 | Heuvel | 280/602 |
| 4,163,565 | A * | 8/1979 | Weber | 280/14.21 |
| 4,340,241 | A | 7/1982 | Crocket | |
| 4,951,960 | A * | 8/1990 | Sadler | 280/607 |
| 5,462,304 | A | 10/1995 | Nyman | |
| 5,580,078 | A | 12/1996 | Vance | |
| 5,687,983 | A * | 11/1997 | Feketa et al. | 280/609 |
| 5,876,056 | A * | 3/1999 | Karlsen | 280/609 |
| 5,954,356 | A * | 9/1999 | Busby et al. | 280/602 |
| 6,193,244 | B1 | 2/2001 | Vance | |
| 6,296,258 | B2 | 10/2001 | Higgins | |
| 6,419,248 | B1 * | 7/2002 | Kay | 280/87.042 |
| 6,655,700 | B1 | 12/2003 | Caputo | |
| 6,834,881 | B2 | 12/2004 | Mash | |
| 6,848,703 | B2 | 2/2005 | Godde | |
| 6,857,641 | B2 * | 2/2005 | Bobrowicz | 280/14.21 |
| 6,910,695 | B2 * | 6/2005 | Ellington | 280/14.22 |
| 7,097,195 | B2 | 8/2006 | Orr | |
| 7,275,755 | B2 * | 10/2007 | Marion | 280/602 |
| 7,296,805 | B2 | 11/2007 | Lindemann | |
| 7,673,885 | B2 * | 3/2010 | Lambert | 280/14.21 |
| 7,748,725 | B2 * | 7/2010 | Piumarta | 280/87.042 |
| 2001/0052687 | A1 * | 12/2001 | Billon et al. | 280/607 |
| 2002/0043774 | A1 * | 4/2002 | Chou | 280/7.12 |

(Continued)

FOREIGN PATENT DOCUMENTS

DE 34444345 A1 6/1986

(Continued)

*Primary Examiner* — John R Olszewski

(57) ABSTRACT

A snow glider comprises a longitudinally-extending runner for supporting a rider on ridden snow and having a generally central, longitudinally-extending slot. The glider further comprises an elevated rider-supporting deck and chatter-absorbing means straddling the slot for supporting the deck above the runner. Preferably, the bottom surface of the runner is preferably generally convex across its width, with curved outer edges that provide directional control to the rider when turning, and at least one longitudinally-extending, generally straight longitudinally-extending inner edge adjacent the periphery of the slot for greater directional control when the rider is going straight. To enhance controllability, the deck of the preferred embodiment is preferably coupled to the runner near the runner's outer periphery so that the force exerted by the rider is transmitted from his/her feet directly to the outer edges of the runner. To further reduce frictional contact with the snow, the bottom surface of the runner is preferably dimpled.

28 Claims, 11 Drawing Sheets

U.S. PATENT DOCUMENTS

| | | | | |
|---|---|---|---|---|
| 2003/0085550 | A1* | 5/2003 | Godde et al. | 280/617 |
| 2003/0155743 | A1* | 8/2003 | Harrison | 280/618 |
| 2003/0193168 | A1* | 10/2003 | Chou | 280/607 |
| 2003/0234513 | A1* | 12/2003 | Zanco | 280/602 |
| 2004/0145152 | A1* | 7/2004 | Santa Cruz et al. | 280/602 |
| 2004/0232657 | A1* | 11/2004 | Lee | 280/618 |
| 2005/0206109 | A1* | 9/2005 | Mash | 280/87.042 |
| 2005/0269794 | A1* | 12/2005 | Lukes | 280/87.042 |
| 2006/0091623 | A1* | 5/2006 | Belt | 280/15 |
| 2007/0267847 | A1* | 11/2007 | Carlson et al. | 280/609 |
| 2008/0048415 | A1* | 2/2008 | Mann | 280/601 |
| 2008/0054578 | A1* | 3/2008 | Lee | 280/14.21 |

FOREIGN PATENT DOCUMENTS

| | | | |
|---|---|---|---|
| DE | 19820619 | A1 | 11/1999 |

* cited by examiner

SNOW GLIDER WITH ELEVATED CHATTER-ABSORBING RIDER DECK

BACKGROUND OF THE INVENTION

A snowboard is a thin, generally hourglass shaped board ridden down a snow-covered slope and/or other section of earth covered in snow. Snowboards are typically 140-165 cm long, although boards for children are as short as 90 centimeters and boards for racers are as long as 215 cm. The typical width of most snowboards is between 24 and 27 cm, although "freestyle" snowboards can typically be as wide as 28 cm to assist with balance while racing snowboards are typically 18-21 cm wide (although some are as narrow as 15 cm). The width is dependant in large part on the rider's foot size since the rider's foot is positioned generally sideways, and the extension of the rider's boot over the perimeter of the board results in unwanted drag of the boot's heel and/or toe portions against the snow. The snowboard's width is conventionally measured at the waist of the board, since the nose and tail widths vary with sidecut and taper. The term "sidecut" refers to the generally symmetrically concave curvature of the snowboard's edges which result in the widths at the tip and tail of the snowboard being greater than the width at its center (or "waist"). This curve aids turning, and affects the snowboard's handling. The curve has a radius that can typically be as short as 5 meters on a child's snowboard or as large as 17 meters on a racer's snowboard. Most snowboards have a sidecut radius of between 8-9 meters.

Snowboards typically comprise a laminated wood core (typically strips of beech, poplar, bamboo or birch glued together) sandwiched between layers of fiberglass. There has been some effort to replace the wooden core with aluminum, composite honeycomb, foam, resin and other materials that exhibit the desired properties of dampening, rebound, strength, flex and reduced weight.

The bottom (or "base") of the snowboard is typically made of various plastic compositions. A strip of metal, typically steel, runs the length the board on each side. This "edge" produces enough friction to ride on ice, and is used to turn the board towards the left or right.

The snowboard's core is sandwiched on the top and bottom by at least two layers of fiberglass, which adds stiffness and torsional strength to the board. Some snowboards also add carbon and Kevlar stringers for additional elasticity and strength.

The top layer (or "top sheet") of the snowboard's laminate structure is usually an acrylic which accommodates printed graphics.

Bindings are attached to the snowboard to tightly hold the rider's boots to the deck. The bindings permit the rider to transfer his/her energy to the board. Typically, three or four screws secure the binding directly to the board, although some bindings require the use of only two screws. There are several types of bindings: strap-in, step-in, and hybrid. The strap-in binding holds the foot to the board with two buckle straps: one strapped across the top of the toe area, and one across the ankle area. The step-in binding snaps onto, and engages, the rider's boots. Other bindings combine features of both these types and are well known to snowboarders and those who manufacture snowboards.

A great deal of design effort has been expended on making snowboards more controllable and to provide the rider with a more ergonomic experience.

SUMMARY OF THE INVENTION

A snow glider is disclosed herein that represents an improvement over conventional snowboards. The snow glider comprises a longitudinally-extending runner for supporting a rider on the ridden snow and having a generally central, longitudinally-extending slot, and chatter-absorbing means straddling the slot for supporting the deck above the runner. As used herein, the term "chatter" refers to the vibration that the runner experiences caused by an uneven surface of snow.

The bottom surface of the runner is generally convex across its width, with curved outer edges that provide directional control to the rider when turning, and at least one longitudinally-extending, generally straight longitudinally-extending inner edge adjacent the periphery of the slot for greater directional control when the rider is going straight.

To enhance controllability, the deck of the preferred embodiment is coupled to the runner near the runner's outer periphery so that the force exerted by the rider is transmitted from his/her feet directly to the outer edges of the runner.

These and other features of the invention are described in the following description of the preferred embodiment, of which the drawings are a part.

DETAILED DESCRIPTION OF THE PREFERRED EMBODIMENT

Figure 1:
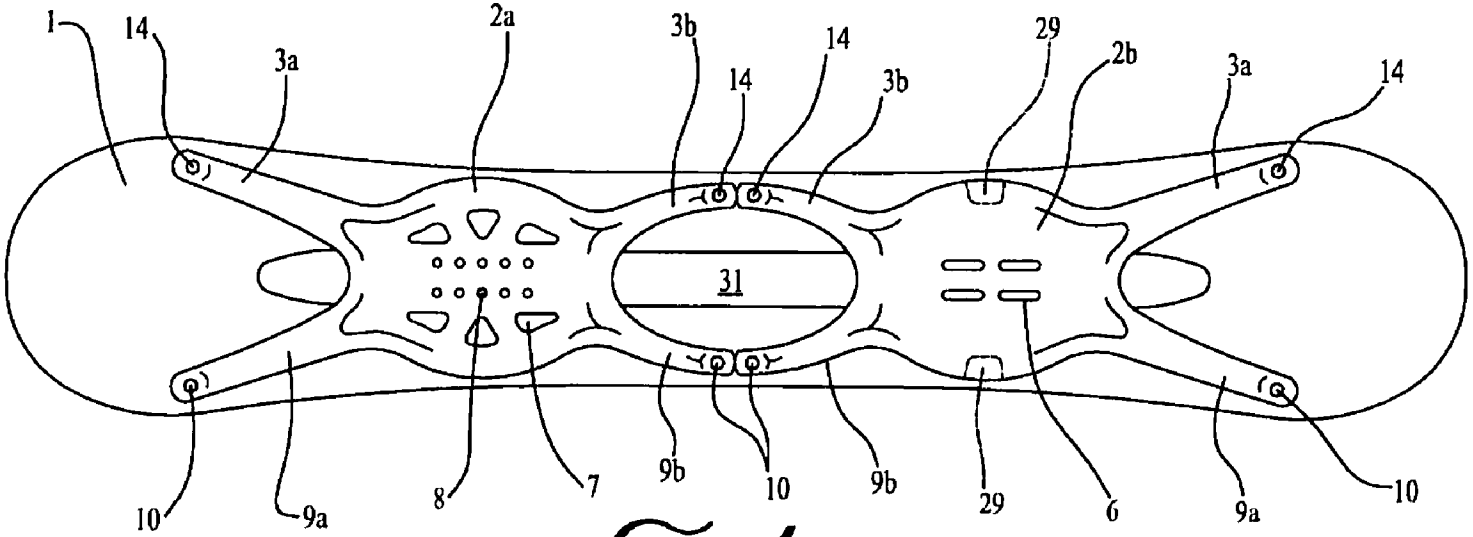
FIG. 1 is a top plan view of a snow glider constructed in accordance with the invention.
Figure 3:
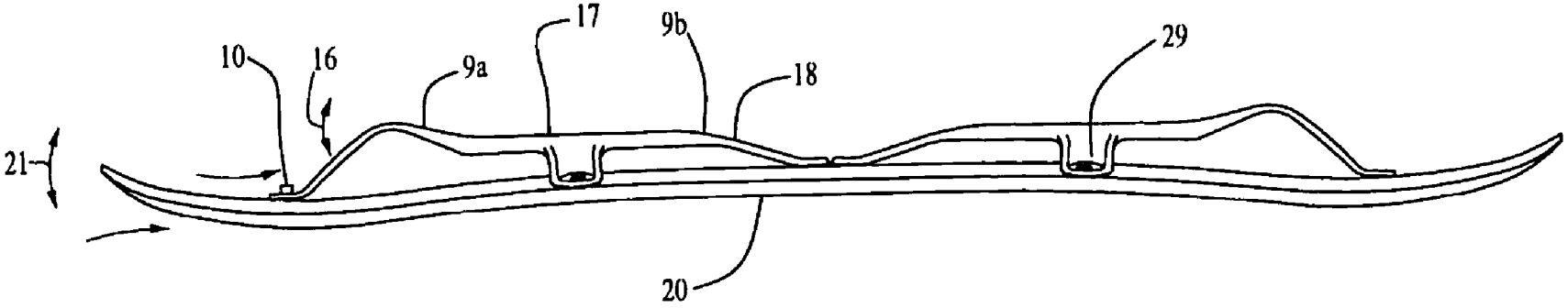
FIG. 3 is a side elevation view of the preferred snow glide in FIG. 1.
Figure 16:
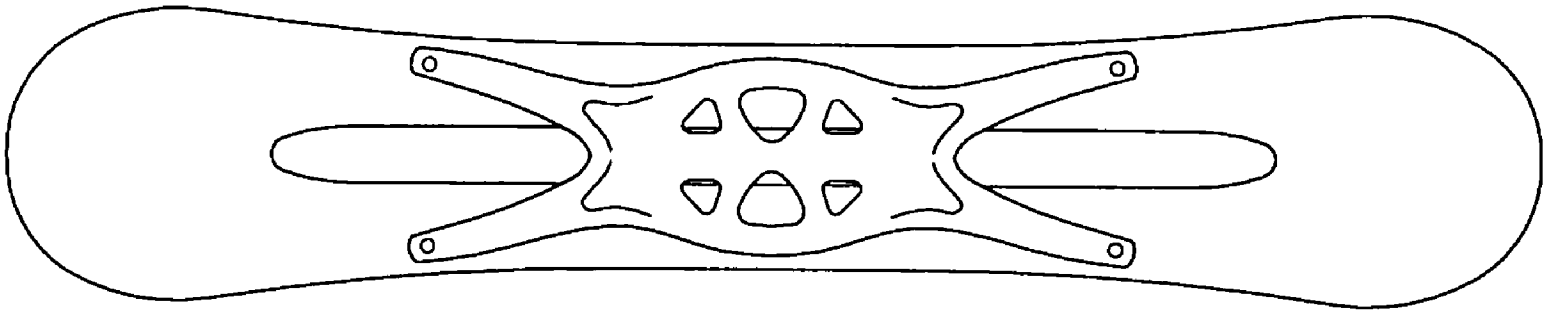
FIG. 16 is a top view of an alternative embodiment of a snow glider constructed in accordance with the invention and having a single deck for a forward-facing rider.
Figure 17:
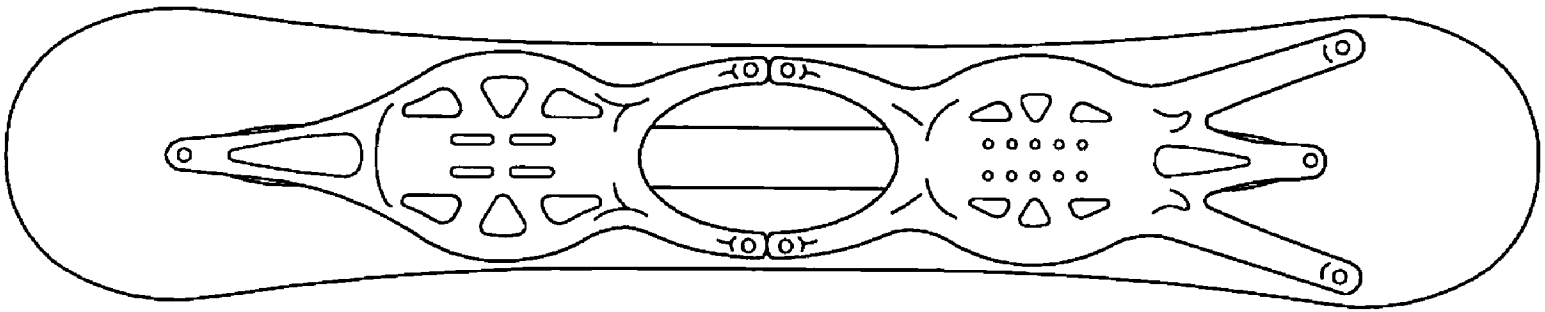
FIG. 17 is a top view of a snow glider constructed in accordance with the invention illustrating two alternative decks.

Referring initially to FIGS. 1 and 3, the preferred snow glider comprises a runner 1 having a pair of decks 2*a*, 2*b* mounted thereon for supporting respective feet of a rider. (A single deck configuration, illustrated by way of example in FIG. 16, is also within the scope of this invention.)

The runner is preferably about 80 cm to 220 cm long, and from 10 cm to 50 cm wide. The runner base has a generally hour-glass contour with curved outer edges similar to a conventional snowboard or ski. It is generally wider at its ends than its midsection, with the ratio of its tip width to waist width being from 10:4 to 10:9.5. The runner has an elongated generally central, longitudinally-extending slot 31 that extends rearward from a position 31*a* to a position 31*b*. The opening 31 extends approximately 30% to 90% of the runner's length and from 10% to 50% of the runner's width, and is preferably close-ended at 31*a* and 31*b*.

Figure 12:
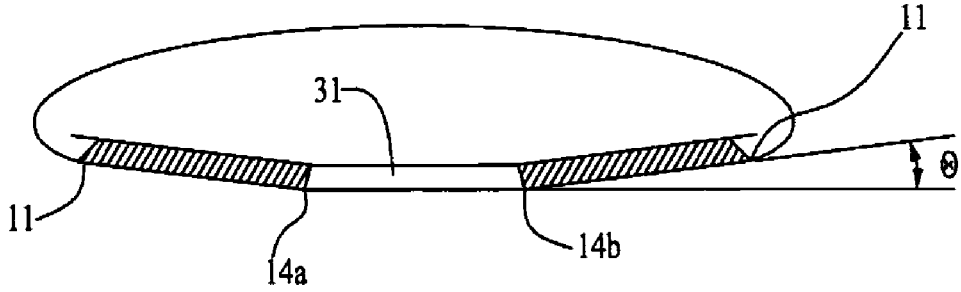
FIG. 12 is a cross-sectional end elevation view in schematic of a runner constructed in accordance with the invention, and taken along line 12-12 in FIG. 4.
Figure 13A:
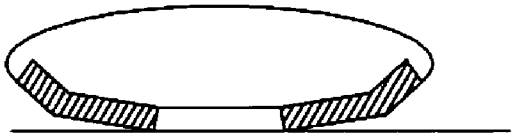
FIGS. 13A-D are respective cross-sectional end elevation views similar to FIG. 12, showing alternative convex base shapes constructed in accordance with the invention.
Figure 13B:
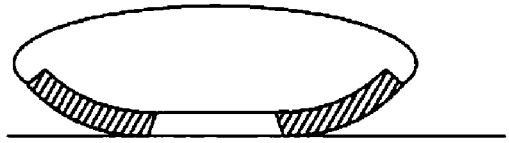
Figure 13C:
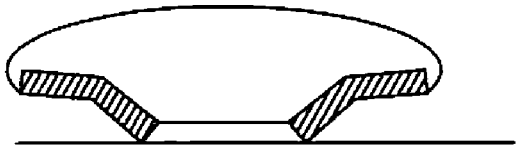
Figure 13D:
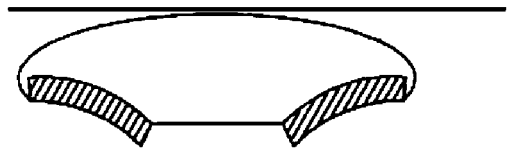
Figure 14:
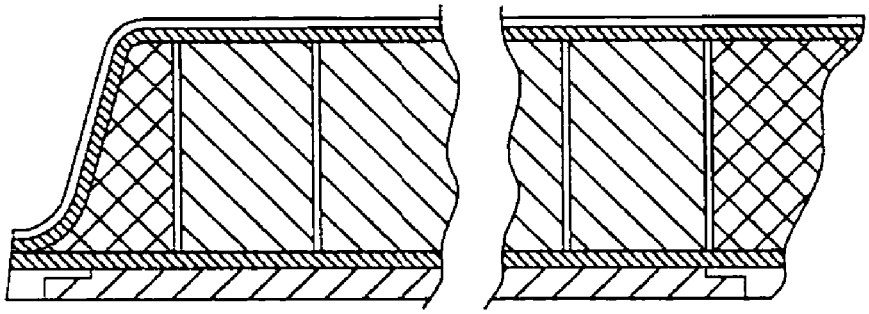
FIG. 14 is a detailed fragmentary cross-sectional elevation view of a preferred wood-core runner on one side of its centerline, showing its details of construction, the runner on the other side of its centerline being a mirror image thereof.
Figure 15:
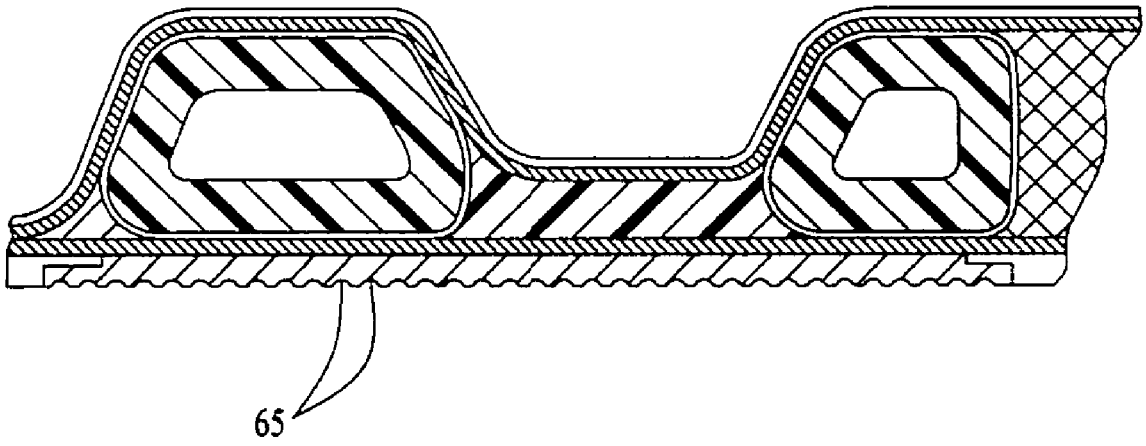
FIG. 15 is a detailed fragmentary cross-sectional elevation view of a preferred composite-core runner on one side of its centerline, showing its details of construction, the runner on the other side of its centerline being a mirror image thereof.

As best shown in FIG. 12, the preferred bottom surface of the runner is generally convex across its width, with a slant or pitch θ of 1°-40°. The term "generally convex" includes "generally V-shaped". Examples of other convex shapes for the bottom surface of the runner are illustrated in FIGS. 13A-D. A dimpled snow-contacting bottom surface 12 (FIG. 12), 65 (FIG. 15) may be provided to reduce drag caused by the runner's friction against the snow. (It may be noted that the dimpled surface 12 is only illustrated on a small portion of FIG. 12 for clarity, but that the dimples preferably cover substantially the entire bottom surface of the runner.)

Figure 4:
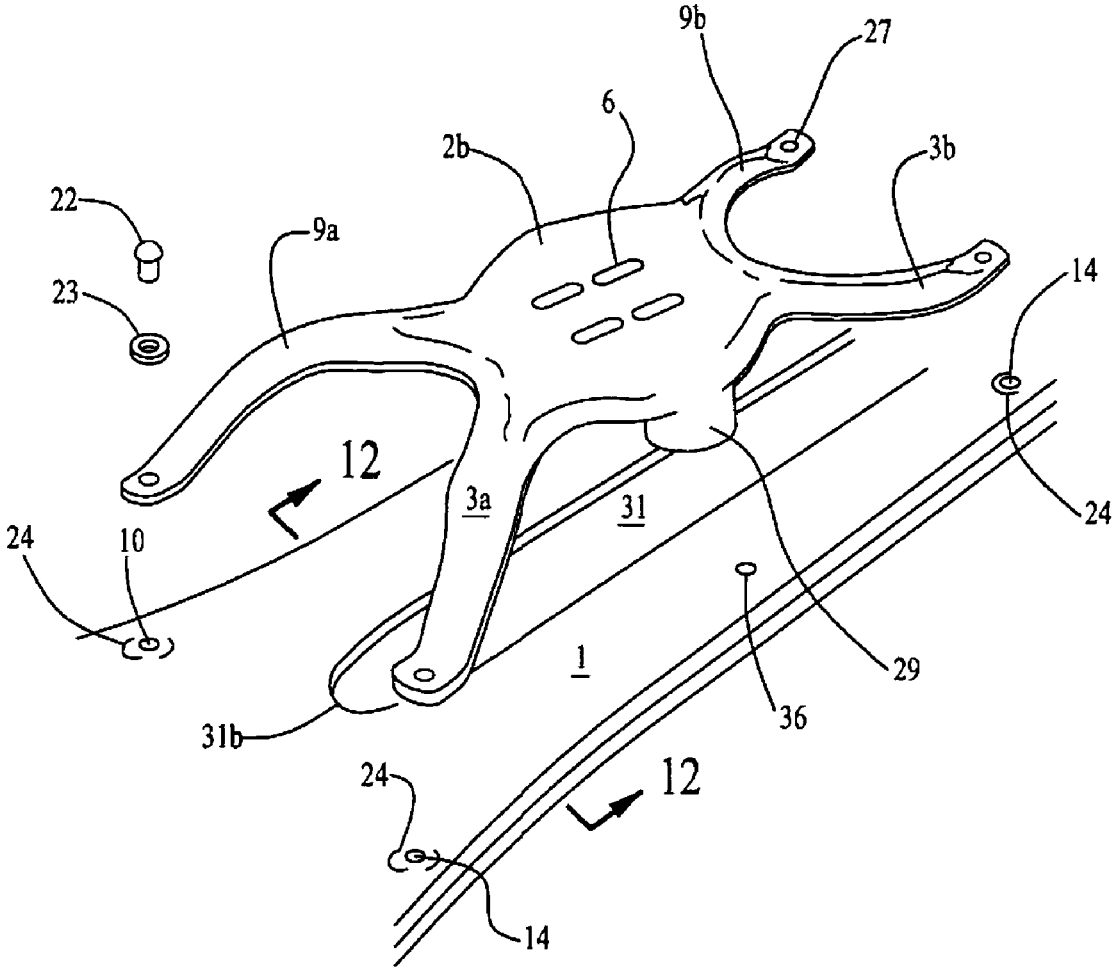
FIG. 4 is a detailed fragmentary explosive rear view in perspective of the preferred deck and runner illustrated in of FIG. 1.

The decks can be constructed of composite, plastic, wood, alloy or any combination of such materials. As shown in FIGS. 1, 3 and 4, the decks are supported above the runner by suspension arms 3*a*, 3*b*, 9*a*, 9*b* that straddle the central slot 31 and are preferably 10-60 cm long. Each deck is mounted to the runner 1 via front and aft outer suspension arms 9*a*, 9*b* on one side of the slot 31 and front and aft inner suspension arms 3*a*, 3*b* on the other side of the slot. The inner suspension arms are each mounted to the deck at a respective mounting location 10, while each outer suspension arm is mounted to the runner at a respective mounting location 14. Preferably, the mounting locations 10, 14 are closely adjacent the runner's periphery.

The deck is preferably secured to the runner via screws 22; however, other methods such as clips, rails, latches and glue can also be used. Details concerning the preferred deck and mounting are best shown in FIG. 4, which is a detailed fragmentary explosive rear view in perspective of the preferred deck 2*a* and runner 1 of FIG. 1. Internally threaded inserts 24 are mounted within the runner to accept respective mounting screws 22 which fasten into the inserts through respective washers 23 and suspension arm.

As illustrated in FIG. 4, a binding attachment rail 6 is mounted on the deck to accommodate the snow glider's binding. The surface area of the deck is approximately 15-30 cm wide and 20-45 cm long. Depending on the material, the thickness is approximately 2 mm to 2 cm. The deck may have a composite tube-like frame similar to a tennis racket; this will tend to make the deck thicker, but much stronger and lighter than other possible structures.

Returning to FIG. 1, the front deck 2*a* is illustrated without its attached binding attachment rail so that certain preferred features of the deck can be appreciated. As illustrated, the deck is conveniently provided with a plurality of optional weight-reducing openings 7, as well as a row of internally threaded binding attachment screw inserts 8 to which a binding or a binding attachment rail 6 can be secured with set screws (not illustrated).

The inner and outer suspension arms act as shock absorbers, substantially isolating the deck (and the rider) from the vibrational "chatter" (i.e., the vibration of a ski or snowboard caused by an uneven surface of snow) that the runner experiences when the glider is ridden. The rider is substantially isolated from chatter because the decks are given a certain degree of movement in a direction generally perpendicular to the runner (hereinafter, the "upward" and "downward" directions).

As best illustrated in FIGS. 3 and 4, the degree of downward travel by each deck is limited by a main deck support 29 that acts as a "stop". The main deck support may affixed to, or formed integrally with, the deck and extend downward therefrom to contact the runner (or surface associated with the runner) at the downward limit of travel. Thus, substantial upward acceleration of the runner, such as happens when encountering a mound, results in more positive contact between the deck and runner to enhance controllability and "feel". The degree of upward acceleration needed for such contact is a matter of design choice.

Alternatively, the main deck support may be affixed to, or formed integrally with, the runner and extend upward towards the deck's bottom surface. One or more deck supports may be utilized, and FIGS. 1 and 4 show the preferred configuration wherein two main deck supports are located at laterally opposite sides of the bottom surface of deck 2*b*. Those associated with deck 2*a* are not illustrated in the drawings.

Figure 2:
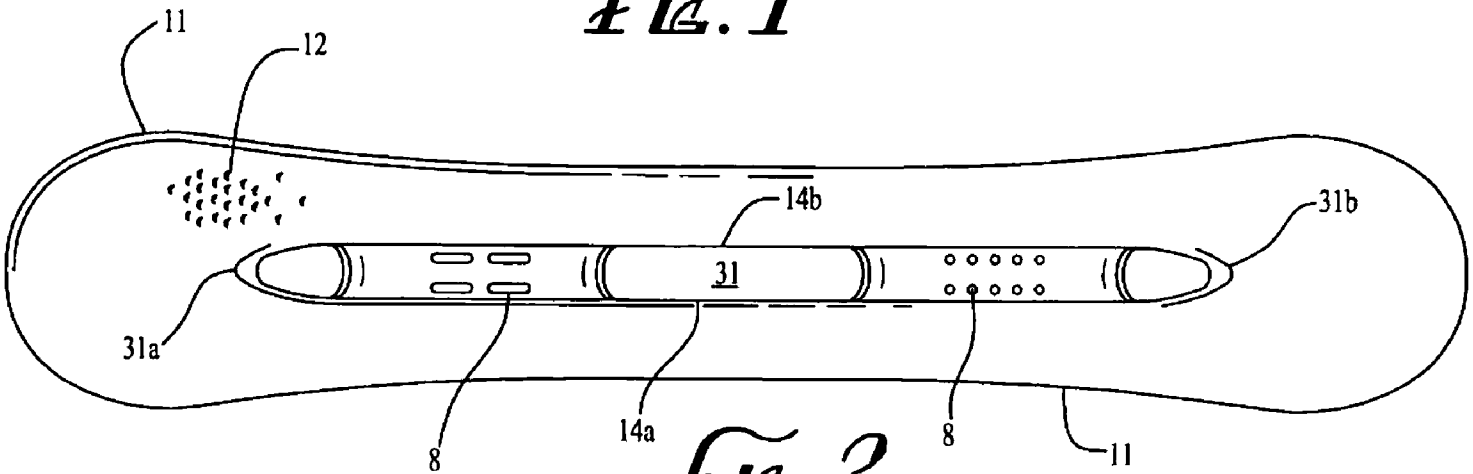
FIG. 2 is a bottom plan view of the preferred snow glider illustrated in FIG. 1.
Figure 11:
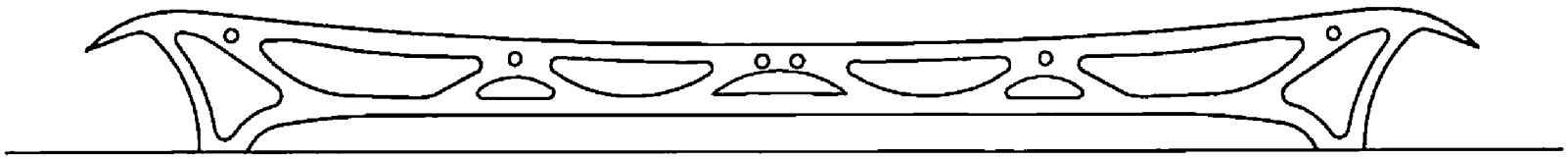
FIG. 11 is a bottom plan view of a composite frame core of a runner of the preferred snow glider, the Figure illustrating the core on one side of its centerline, the other side of the core being a mirror image thereof, the top and bottom surfaces being the same.

As best shown in the bottom view of the preferred snow glider illustrated in FIG. 2, and in FIG. 11, the runner has a curved outer metallic edge 11, typically of steel, that runs the length the runner on each side to provide directional control to the rider when turning. The runner preferably further includes a pair of longitudinally-extending generally straight inner edges 14*a*, 14*b* that run along the longitudinally-extending periphery of the elongated generally central slot 31. The generally straight edge(s) are centrally located so as to contact the snow during generally straight-line riding, while the outer curved edges are held in a higher position away from firm contact with the snow by the generally concave configuration of the glider's bottom surface.

Figure 21A:
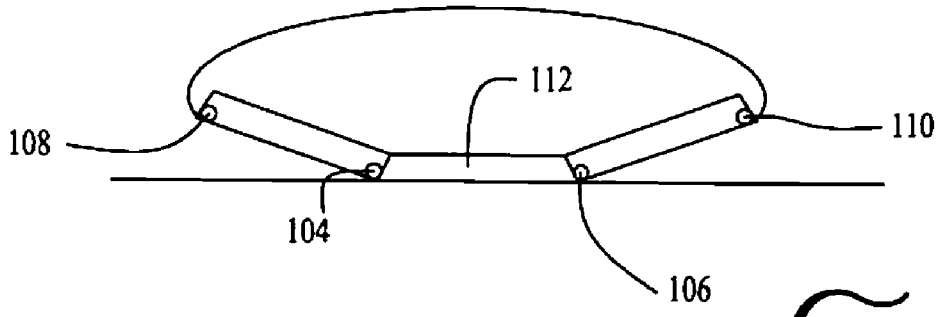
FIG. 21A-C are cross-sectional views in schematic of a preferred runner constructed in accordance with the invention, illustrating the manner by which the edges of the snow glider engage the snow.
Figure 21B:
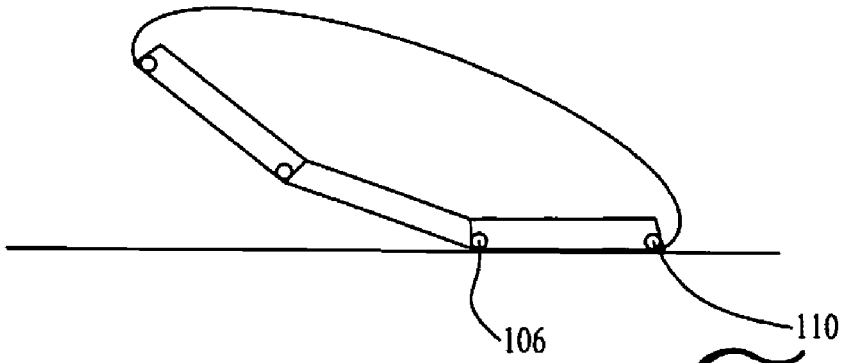
Figure 21C:
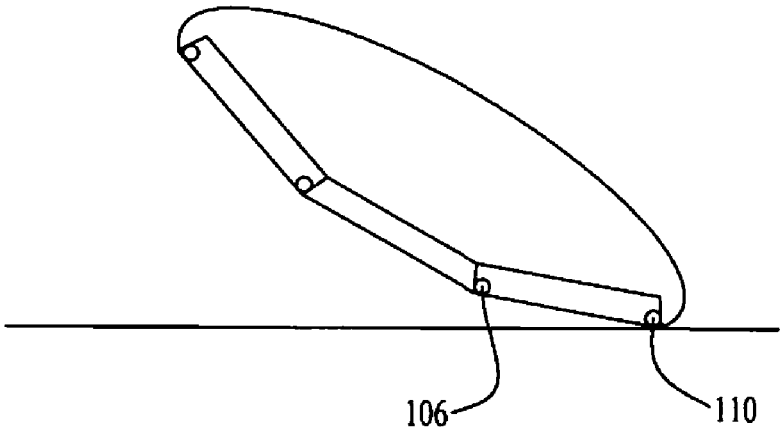

The generally convex shape of the glider's bottom surface permits the rider to simply center his/her weight to the centerline of the glider to permit one or both inner edges to engage the snow. Because the curved outer edges are positioned above the snow owing to the convex shape of the glider's bottom surface, the glider does not wander as it glides in a straight line. Reference is made to FIG. 21A-C by way of illustration, which schematically illustrate a cross-section of the preferred runner. In FIG. 21A, the runner is oriented for generally straight travel, with a pair of generally straight, longitudinally-extending edges 104, 106 engaging the snow as the outer curved edges 108, 110 are held above the snow by the convex shape of the runner's bottom surface. As illustrated, the inner edges extend along the generally central elongated slot 112 of the preferred glider's runner. FIG. 21B illustrates the runner's orientation as the glider's rider turns relatively gently by banking the runner so as to catch the outer edge in the snow. The glider turns relatively gently, since one of the straight inner edges retains contact with the snow and generates frictional contact as it is forced to curve within the snow, thereby producing a comparatively large turning radius. A more radical bank is illustrated in FIG. 21C, wherein the outer edge engages the snow, the inner edges do not, and the curved shape of the outer edge enhances the turning movement of the glider vis-à-vis conventional snowboards to produce a comparatively smaller turning radius. It may be noted that, by contrast, conventional snowboards have a flat base, causing the rider to catch the left edge or right edge of the board when going straight, dragging the rider to one side or the other, causing chatter and forcing the rider to constantly micro-adjust his/her balance.

The pair of generally straight inner edges 14*a*, 14*b* thus gives the rider two additional edges for greater directional control when the rider is going straight. As with the outer edges 11, the inner edges are preferably formed from a metal such as steel. The runner may alternatively be provided with more than, or less than, two generally straight inner edges.

The preferred placement of the mounting locations 10, 14 near the runner's periphery enhances the rider's control of the glider compared with conventional snowboards because the force exerted by the rider is transmitted from his/her feet directly to the outer edges of the runner. In addition, the location of the preferred laterally-opposite main deck supports near the outer edges of the runner also helps the rider transfer his/her weight directly to the outer edges of the glider, helping the glider dig into the snow for sharper and more stable turns, particularly in icy conditions. The presence of the inner edges 14*a*, 14*b* further enhances the glider's performance and controllability when going straight, while the convex shape of the base and the high center of gravity of the deck-mounted rider further enhance the performance and controllability of the glider during turning movements. The elongated slot 31 reduces the friction generated by the runners contact with the snow, as well as the effect of snow accumulation under the runner, while enhancing the bi-directional functionality the runner when the slot is close-ended at both ends.

The combination of the foregoing features, together with the higher center of gravity of the resulting configuration help the rider shift his/her weight from edge to edge, making the turns quicker and smoother in execution, and providing the rider with an enhanced "feel" of the hill that is superior to prior art snowboards.

Moreover, the snow glider thus described accommodates a dual deck configuration, as illustrated in FIG. 1 for example, or a single rider's deck as illustrated by way of example in FIG. 16. The dual decks can be molded as one deck with an O-shaped opening in the middle, or as two separate pieces. Depending on the type of riding condition the board is designed for, the deck(s) are preferably mounted symmetrically about the mid-point of the board's length, or from 1 cm to 30 cm aft of the midpoint.

Since the rider is mounted on the deck, and not directly on the runner, the deck can be made to ergonomically fit the rider; e.g., the deck can be slanted inward toward the center of the board. Moreover, the bindings can be mounted on the decks to accommodate the "surfer stance" (like a snowboarder) or the forward stance (like a mono skier). For riders preferring the "surfer" stance, the decks are preferably designed with standard snowboard binding mounting screws, inserts or rails. Quick release, or tension release latches can be mounted as part of the decks. For riders preferring the forward facing stance or the mono ski stance, standard ski bindings can be mounted directly onto a single rider's deck which is mounted symmetrically about the mid point of the board or from 1 cm to 30 cm aft of the midpoint, as with conventional skis.

A pop down a fork can be mounted on the bottom side of the deck to function as a snow brake. Preferably, the fork extends down through the central opening in the runner, and is foot-operable against a retraction spring.

Figure 5:
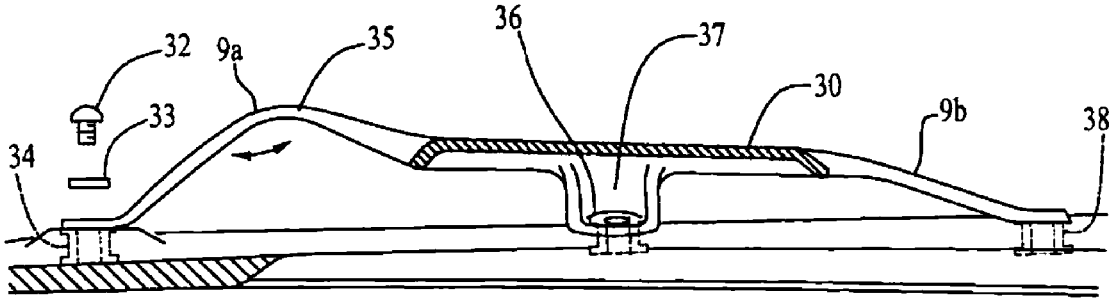
FIG. 5 is a fragmentary side view of an alternative embodiment of a deck mounting in accordance with the invention.

FIG. 5 is a fragmentary side view of an alternative embodiment of a deck mounting in accordance with the invention. The deck 30 is illustrated as having a downwardly-facing support 37 formed integrally with the deck. The deck includes support arms fastened to the runner via mounting screws 32 that threadily engage internally-threaded screw inserts 34, 38 within the runner. The support 37 includes a through-hole positioned to overlie a support and internally threaded insert 36 so that the support 37 can be secured to the runner with a set screw (not illustrated). Alternatively, guide means may be provided for permitting limited upward/downward movement of the support 37; for example, the through-hole they circumvent a guide member that extends upwardly from the runner through the through-hole to permit the support 37 a limited degree of upward/downward travel in the course of absorbing "chatter", or the deck may have a downwardly-extending member which is guided for such restricted movement by a guide member associated with the runner.

It can be noted at this juncture that, as illustrated in FIGS. 4 and 5, the outer support arms 3*b*, 9*b* are preferably shaped differently than the inner support arms 3*a*, 9*a*. The preferred inner support arms 3*a*, 9*a* are comparatively linear in their lengths while the outer support arms 3*b*, 9*b* have a dog-leg, or knee, portion 35. In addition to helping to absorb chatter by flexing in the direction shown by the arrow in FIG. 5 underlying the dog leg, the dog-leg improves the ability of the rider to "jump the board". Referring to FIG. 5, and assuming the rider is traveling from left to right with the illustrated portion of the snow glider underlying the rider's rear foot, the rider will press his/her rear foot downward in preparing for the jump. The illustrated deck pivots downward about mounting screw 38 owing to the difference in arm configurations, with the outer support arm 9*b* and dog-leg portion 35 flexing accordingly. As the rider lifts his/her rear foot upward into the jump, the potential energy stored in the flexed arms is unleashed, with the resulting kinetic energy assisting the rider in imparting upward momentum to his/her foot and, consequently, to the runner via the binding to provide extra spring and enhance the jump. Conversely, the shock experienced by the rider in the runner's landing contact with the ground is at least partially absorbed by the supporting arms described herein to smooth out the landing and assist the rider in retaining control of the glider.

Figure 6:
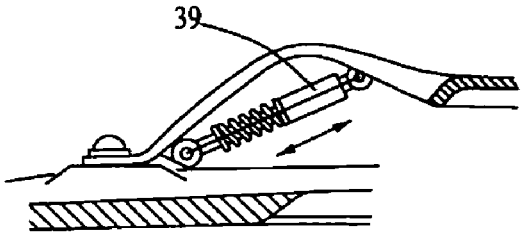
FIG. 6 is a partial fragmentary side view of a deck constructed in accordance with the invention, showing an alternative embodiment of the shock-absorbing feature of the invention.

In accordance with another embodiment of the invention, adjustable shocks and/or springs can be used to enhance the ride. FIG. 6 illustrates an alternative chatter-absorbing configuration for the deck wherein a piston-type shock absorber 39 is coupled between the downward-facing surfaces of the deck's suspension arm to add additional shock-absorbing capability. The shock absorber is of the pneumatic or hydraulic type similar to that found on two and four-wheeled vehicles, and may be adjustable to provide a degree of stiffness that can be modified by the rider.

Figure 7:
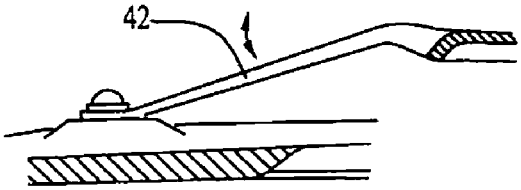
FIG. 7 is a partial fragmentary side view of an alternative deck configuration constructed in accordance with the invention.

FIG. 7 illustrates an alternative configuration for the deck's suspension arm to provide a different degree of stiffness. The suspension arm 42 is configured to have a more linear shape then the comparatively dog-legged shape of the suspension arm illustrated in FIG. 6, for example.

Figure 8:
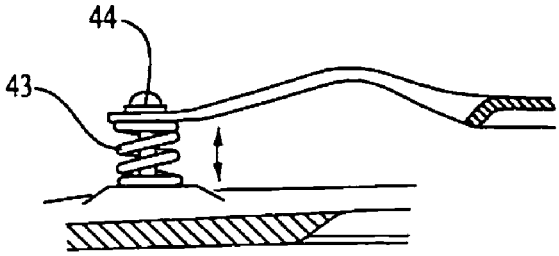
FIG. 8 is a partial fragmentary side view of a deck constructed in accordance with the invention, showing an alternative configuration for coupling the deck to the runner of the snow glider.
Figure 9:
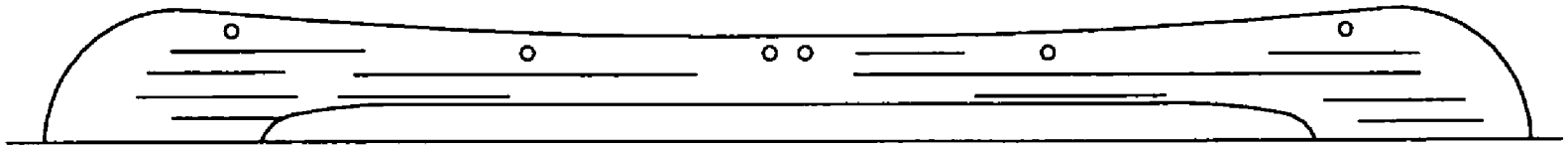
FIG. 9 is a plan view of a full wood core of a runner of the preferred snow glider, the Figure illustrating the core on one side of its longitudinally-extending centerline, the other side of the core being a mirror image thereof, the top and bottom surface being the same.
Figure 10:
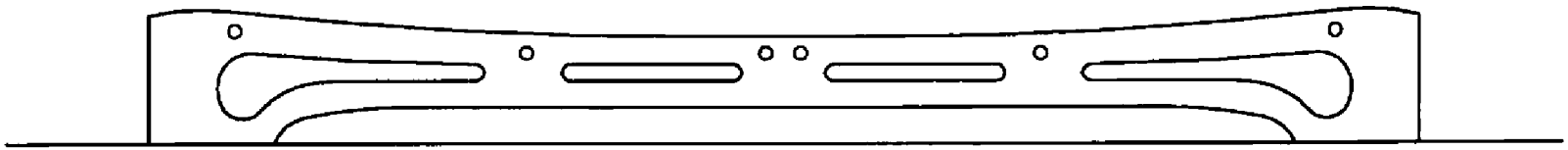
FIG. 10 is a plan view of an alternative semi-full wood core of a runner of the preferred snow glider with cut-outs between the outer edge and inner edge to reduce weight, the Figure illustrating the core on one side of its longitudinally-extending centerline, the other side of the runner up being a mirror image thereof, the top and bottom surfaces of the core being the same.
Figure 18A:
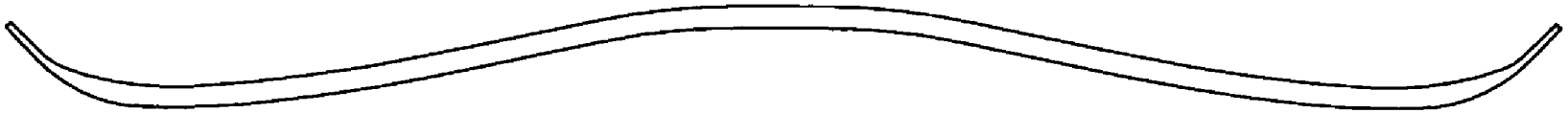
FIG. 18A-C are side views in schematic of alternative embodiments of a runner of a snow glider constructed in accordance with the invention and illustrating alternative cambers; e
Figure 18B:
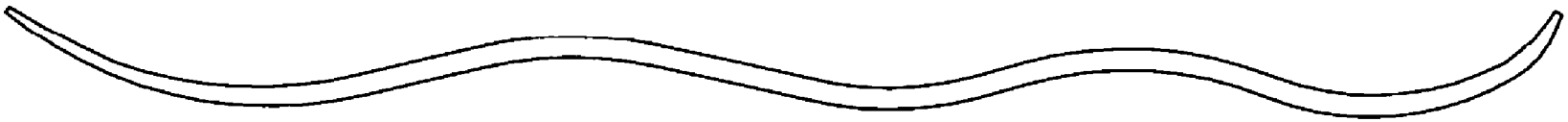
Figure 18C:
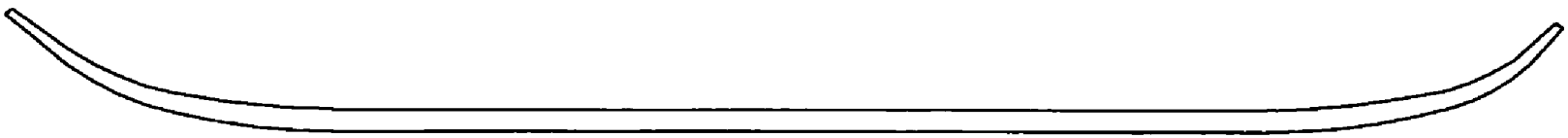

FIG. 8 illustrates yet another alternative configuration for absorbing "chatter". The deck's suspension arm is secured to the runner via a screw 44 which passes through a compression spring 43 that separates the end of the suspension arm from the runner. The spring 43 further absorbs "chatter", supplementing the absorption by the deck's The runner itself can be provided with any of a number of cambers, some of which are illustrated in FIGS. 18A-C, which are a side views in schematic of a runner constructed in accordance with the invention. FIG. 18A illustrates a single camber wherein center portion of the runner is higher than the portions adjacent its ends. FIG. 18B illustrates a double camber, wherein the bottom surface of the runner is lower at its end regions and center region than the regions therebetween. FIG. 18C illustrates a flat camber wherein substantially the entire length of the runner is flat.

Lastly, it should be recognized that the width of the runner is no longer limited by the foot size of the rider. Conventionally, the runner has had to be wide enough to prevent the heel and/or toe portions of the rider's foot from dragging through the snow. With the raised deck of the snow glider described herein, the rider's feet are supported above the snow on the elevated deck(s) permitting a reduction in runner width and consequential friction with the snow to the extent desired.

Figure 19A:
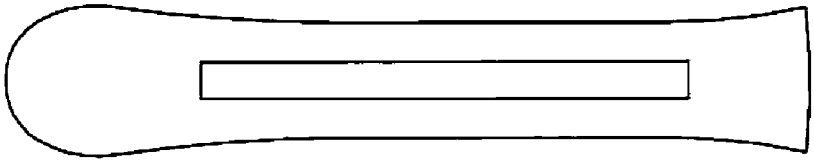
FIG. 19A-C are schematic top plan views of alternative runners constructed in accordance with the invention.
Figure 19B:
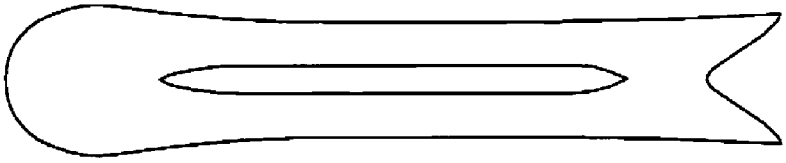
Figure 19C:
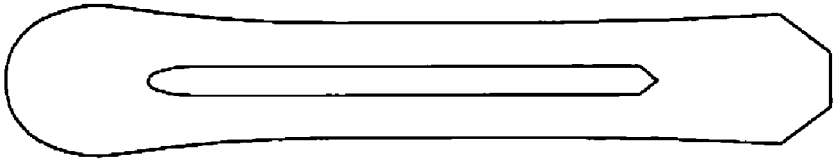
Figure 20A:
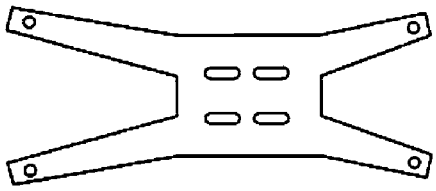
FIGS. 20A-B are top plan views in schematic of alternative deck shapes in accordance with the invention.
Figure 20B:
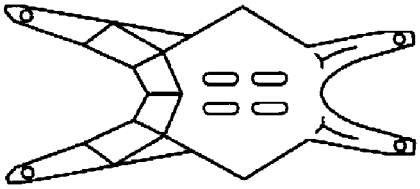

Although the present invention and its advantages have been described in detail, it should be understood that various changes, substitutions and alterations can be made herein without departing from the spirit and scope of the invention as defined by appended claims. For example, a variety of runner shapes can be utilized as exemplified in schematic in FIGS. 19A-C. Various deck shapes can be utilized as well, as exemplified in schematic in FIGS. 20A-B. Neither the illustrations nor the detailed description of the preferred and alternative embodiments are intended to limit the scope of the invention in any way.

I claim:

1. A snow glider comprising:

a longitudinally-extending runner for supporting a rider on the ridden snow and having an elongated generally central opening;

at least one deck supported above the runner for supporting the rider; and chatter-absorbing means including suspension arms extending longitudinally from the at least one deck to the runner for supporting the deck above the runner, at least a portion of the suspension arms straddling the generally central opening to support the deck on opposite sides of the opening.

2. The snow glider of claim 1 wherein the chatter-absorbing arms couple the at least one deck to the runner closely adjacent the runner's periphery.

3. The snow glider of claim 2 wherein the snow-facing bottom surface of the runner is generally convex across its width.

4. The snow glider of claim 3 wherein the convex shape has a pitch in the range of approximately 1°-40°.

5. The snow glider of claim 4 wherein the pitch is an angle lying within the range of approximately 1°-40°.

6. The snow glider of claim 2 wherein the chatter-absorbing arms are approximately 10-30 cm long.

7. The snow glider of claim 2 wherein the chatter-absorbing arms couple the deck to the runner at locations near the runner's periphery.

8. The snow glider of claim 2 wherein the surface area of the at least one deck is between approximately 15-30 cm wide and between approximately 20-45 cm long.

9. The snow glider of claim 2 wherein the thickness of the at least one deck is approximately 2 mm to 2 cm.

10. The snow glider of claim 2 wherein the deck has a composite tube-like frame.

11. The snow glider of claim 2 wherein the at least one deck has a plurality of weight-reducing openings.

12. The snow glider of claim 2 wherein the at least one deck has a rider-facing top surface having a row of internally threaded holes to which a binding attachment rail can be secured with screws.

13. The snow glider of claim 1 wherein the elongated generally central opening extends approximately 30% to 90% of the runner's length.

14. The snow glider of claim 1 wherein the elongated generally central opening extends 10% to 50% of the runner's width.

15. The snow glider of claim 1 wherein the runner has a curved outer metallic edge that runs the length the runner at each side to provide directional control to the rider when turning.

16. The snow glider of claim 1 wherein the runner has at least one generally straight longitudinally-extending inner edge extending longitudinally adjacent the periphery of the elongated opening to provide the rider with directional control when the rider is going in a generally straight direction.

17. The snow glider of claim 1 including means for stopping the movement of the at least one deck towards the runner prior to its contacting the runner as the at least one deck undergoes chatter-absorbing movement in a direction generally perpendicular to the runner.

18. The snow glider of claim 17 wherein the stopping means includes a structural component affixed to the deck and extending generally downward therefrom towards the runner to be stopped at the limit of travel.

19. The snow glider of claim 18 wherein the stopping means includes a structural component formed integrally with the deck and extending generally downward therefrom towards the runner to be stopped at the limit of travel.

20. The snow glider of claim 18 wherein the stopping means includes a structural component affixed to the runner and extending generally upward therefrom towards the deck to stop the deck at its limit of travel.

21. The snow glider of claim 18 wherein the stopping means includes a structural component formed integrally with the deck and extending generally upward therefrom towards the deck to stop the deck at its limit of travel.

22. The snow glider of claim 21 wherein the runner has at least one generally straight inner edge extending longitudinally adjacent the elongated opening to provide the rider with directional control when the rider is going in a generally straight direction.

23. The snow glider of claim 17 wherein the elongated generally central opening extends approximately 30% to 90% of the runner's length.

24. The snow glider of claim 17 wherein the elongated generally central opening extends 10% to 50% of the runner's width.

25. The snow glider of claim 17 wherein the runner has a curved outer metallic edge that runs the length the runner at each side to provide directional control to the rider when turning.

26. The snow glider of claim 25 wherein the runner has at least one generally straight inner edge extending longitudinally adjacent the elongated opening to provide the rider with directional control when the rider is going in a generally straight direction.

27. The snow glider of claim 1 including a piston-type shock absorber mounted between the deck and the runner.

28. A snow glider comprising:

a longitudinally-extending runner for supporting a rider on the ridden snow and having an elongated generally central opening;

at least one deck supported above the runner for supporting the rider;

chatter-absorbing means for supporting the deck above the runner, at least a portion of the chatter-absorbing means straddling the generally central opening to support the deck on opposite sides of the opening; and means for stopping the movement of the at least one deck towards the runner prior to its contacting the runner as the at least one deck undergoes chatter-absorbing movement in a direction generally perpendicular to the runner, the stopping means being positioned to couple the force exerted by the rider to the periphery of the runner.

* * * * *